United States Patent [19]

Stepan

[11] Patent Number: 5,000,202

[45] Date of Patent: Mar. 19, 1991

[54] LIPSTICK SAMPLING DEVICE

[76] Inventor: James P. Stepan, 2340 NE. 50th St., Lighthouse Point, Fla. 33064

[21] Appl. No.: 462,552

[22] Filed: Jan. 9, 1990

[51] Int. Cl.[5] ..... A45D 40/26

[52] U.S. Cl. ..... 132/320; 604/1

[58] Field of Search ..... 132/319, 320; 604/1, 604/2

[56] References Cited

U.S. PATENT DOCUMENTS

| | | | |
|---|---|---|---|
| 1,652,108 | 12/1927 | Forbis | 604/1 |
| 1,944,691 | 1/1934 | Libby | 132/319 |
| 2,325,968 | 8/1943 | Moore et al. | 132/320 |
| 2,646,054 | 7/1953 | Greene et al. | 132/320 |
| 2,705,009 | 3/1955 | Plantinga et al. | 604/1 |
| 2,834,356 | 5/1958 | Weiler | 132/320 |
| 3,343,552 | 9/1967 | Steffen | 132/320 |
| 4,611,611 | 9/1986 | Beal | 132/320 |

FOREIGN PATENT DOCUMENTS

| | | | |
|---|---|---|---|
| 2129143 | 10/1972 | France | 132/319 |

*Primary Examiner*—John J. Wilson
*Assistant Examiner*—Frank A. LaViola
*Attorney, Agent, or Firm*—Charles E. Temko

[57] ABSTRACT

Device is a cylindrical stick made of paper, cloth, plastic, wood, metal, or other synthetic resinous material impregnated on its inner surface with a portion of cosmetic lipstick product. The shaft is supported during horizontal orientation by two finger held ends of the cylindrical shaft which allow for easy placement of the device between the lips and transfer of the corresponding lipstick product to the lips.

1 Claim, 1 Drawing Sheet

LIPSTICK SAMPLING DEVICE

BACKGROUND OF THE INVENTION

This invention is a finger held device which provides for individual single use sanitary sampling of cosmetic lipstick. The primary purpose of this sanitary sampling device is to provide the cosmetics consumer with a means to safely apply lipstick products to her lips.

The prospective purchaser of lipstick products has difficulty selecting the most suitable lipstick shade unless that purchasing consumer can actually apply the particular lipstick, directly to her lips, and compare the color, texture, etc. to her personal preference. As it stands today there is no commonly used cosmetic lipstick sample applicator which serves this purpose.

In the U.S. Pat. No. 4,611,611, there is disclosed a device which intends to provide a means of sampling cosmetic lipstick. This device comprises of a folded piece of paper or other tissue carrying the lipstick sample on a flat surface and enclosed within a cover. The lipstick sample application process is a matter of transferring the lipstick product from the paper applicator to the lips. In order to transfer the lipstick the sample applicator is placed between the lips as the lips are pressed down on the sample. While the lips are pressing on the surface of the paper containing the lipstick portion the transfer is made from the paper applicator to the lips.

SUMMARY OF THE INVENTION

This new invention provides for a different approach by which the cosmetic lipstick sample is applied to the inner length of an elongated stick made from cloth, wood, plastic, metal. The middle portion of the stick is coated with the lipstick sample. The outer ends of the stick are for finger grasping from both the left and the right hand. The sample is applied when the middle of the stick carrying the lipstick sample is placed lengthwise between the lips and by pressing or rolling the sample applicator the lipstick product is transferred from the surface of the stick to lips.

WHEREAS this cosmetic lipstick applicator coincides, in many ways, with the cotton swab, a commonly used personal care product, this invention differentiates itself clearly by its actual mode of application. Whereas the cotton swab has many uses its designated usage is hand held in the middle of the stick while either end is used for application. This new device, is designated in order to maintain a product different from itself on the surface of the middle of the stick for the exact purpose of transferring that product to its desired personal use on the human lips.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
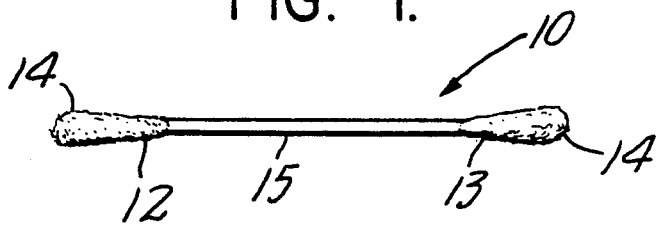
FIG. 1 is a side elevational view of an embodiment of the invention.
Figure 2:
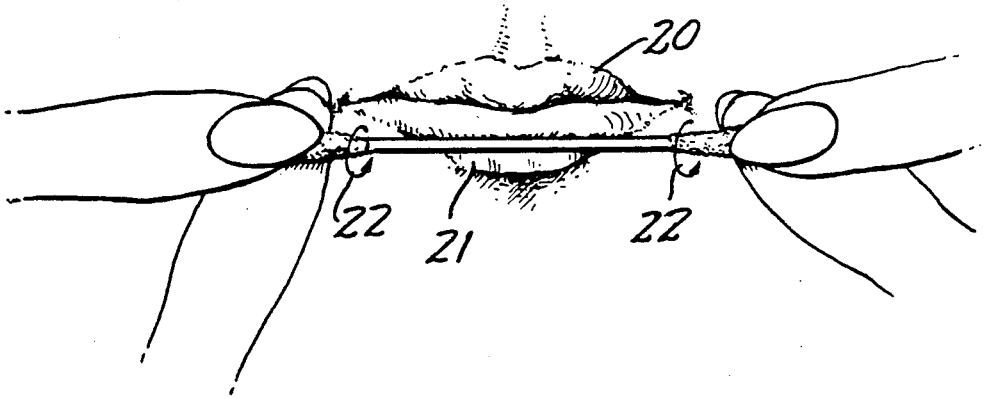
FIG. 2 is a similar side elevational view showing the embodiment in use in the application of a sample coating to the lips of a user.
Figure 3:
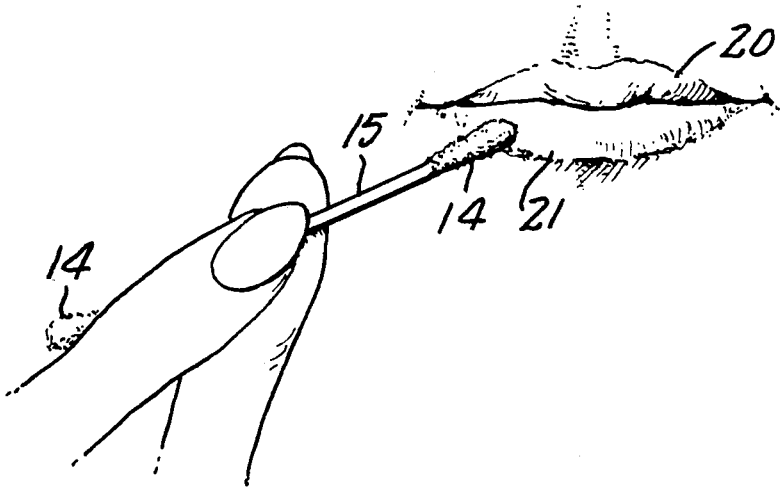
FIG. 3 is a similar side elevational view showing the embodiment in use in the removal of the sample.

In accordance with the invention, the device, generally indicated by reference to character 10 is a form of a stick including a cylindrical shaft 11 of paper, cloth, plastic, wood, metal or other synthetic resinous materials. The length of the inner shaft is commonly about 5 cm with a diameter of approximately 3mm. At either end of the cylindrical shaft, first end 12 second end 13 are, according to this example of the device, two directly attached bulbous heads 14 of approximately 1 cm of length and 5mm of diameter each.

Whereas the middle of the shaft 11 is covered on its surface with the cosmetic lipstick sample the application of the lipstick sample occurs when the device is suspended between the forefingers of each hand. The sample is transferred when the user presses and rotates the device until the lipstick sample covers her lips and the device is removed. The sample application process is simple and easy, once the device is placed between the lips the user normally applies the transfer according to her own preferred style.

This sanitary sample applicator of cosmetic lipstick products is to be a single use/single person applicator and is designed to be discarded after its one use.

I wish it to be understood that I do not consider the invention to be limited to the precise details of structure shown and set forth in this specification, for obvious modifications will occur to those skilled in the art to which the invention pertains.

I claim:

1. An improved lipstick sampling device comprising: an elongated stick swab including a cylindrical shaft portion having first and second ends, said shaft portion having a continuous outer surface between said ends, and a coating of lipstick material on said outer surface; both said ends having an enlarged tip of felted cotton.

* * * * *